US006102163A

United States Patent [19]

Liebetrau et al.

[11] Patent Number: 6,102,163

[45] Date of Patent: Aug. 15, 2000

[54] ELEVATOR CAR WITH CONTROL BOX

[75] Inventors: Christoph Liebetrau, Menziken; Utz Richter, Ebikon; Kaspar Schindler, Unterkulm, all of Switzerland

[73] Assignee: Inventio AG, Hergiswilnw, Switzerland

[21] Appl. No.: 09/055,715

[22] Filed: Apr. 6, 1998

[30] Foreign Application Priority Data

Apr. 11, 1997 [EP] European Pat. Off. ..... 97810219

[51] Int. Cl.[7] ..... B66B 9/02

[52] U.S. Cl. ..... 187/250; 187/270

[58] Field of Search ..... 187/413, 414, 187/267, 268, 289, 270, 249, 250

[56] References Cited

U.S. PATENT DOCUMENTS

| | | | |
|---|---|---|---|
| 1,923,603 | 8/1933 | Winslow | 187/249 |
| 3,707,205 | 12/1972 | Gibson | 187/413 |
| 4,043,430 | 8/1977 | Kraft et al. | 187/413 |
| 5,558,181 | 9/1996 | Bundo | 187/270 |

FOREIGN PATENT DOCUMENTS

| | | | |
|---|---|---|---|
| 0 330 809 | 9/1989 | European Pat. Off. . | |
| 0 745 552 | 12/1996 | European Pat. Off. . | |
| 3221415 | 12/1983 | Germany . | |
| 2087351 | 5/1983 | United Kingdom | 187/270 |

*Primary Examiner*—Kenneth W. Noland
*Attorney, Agent, or Firm*—MacMillan, Sobanski & Todd, LLC

[57] ABSTRACT

An elevator system control box is mounted on an elevator car above or below a car door. The mounting position of the control box makes it possible for a service technician to reach elevator drive system components, such as a travel regulation unit, safety circuits, an optional drive regulation unit, a frequency inverter, etc., mounted in the control box conveniently standing at hand or eye level at a floor with the shaft doors opened.

15 Claims, 4 Drawing Sheets

ELEVATOR CAR WITH CONTROL BOX

BACKGROUND OF THE INVENTION

The present invention relates to an elevator with, for example, a drive system mounted at the car.

An elevator having a drive system mounted at the car is shown in the European Patent Application No. EP 745 552.

SUMMARY OF THE INVENTION

The present invention is based on the task of making possible maintenance and servicing of such an elevator car in simple manner without increasing the size of the car by adding large external attachments. The control box according to the present invention allows a service technician to conveniently reach the electrical components of the elevator car, such as a travel regulation unit, safety circuits, an optional drive regulation unit, a frequency inverter, etc., at a building floor at hand or eye level.

The task is achieved by arranging the control box below or above the car door. If the car is stopped in front of a hall door with the control box at half height and then the hall door is opened, the service person has convenient access to all components. On the other hand, the control box does not occupy any space that would otherwise be used and it has no influence on the dimensions of the car and the required shaft space. The mounting of the control box on the side of the car at which the drive is disposed, top side or bottom side, saves a long connecting cable when the drive is located at the bottom, thus below the car door.

An apron plate serving to cover the control box prevents an unintended falling of persons or objects into the shaft when it is pushed downwardly in front of the shaft opening still remaining free. In the case of a maneuvering incapacity of the car at an unfavorable position, the control box can also be drawn into the car and, if needed, be reversed. Since in that case the electrical connection to the supplied or regulated components of the elevator is maintained, test trips can also be undertaken in this state with the car floor tipped up in its entirety, step plates below the car floor offering the service person a secure platform.

Thus, the present invention concerns an apparatus for housing a control system for an elevator system, the elevator system including an elevator car for the transport of persons or goods, the elevator car having a car door as well as a drive system attached thereto. The apparatus includes a control box having a hollow interior for housing elevator drive system components therein, the control box being formed with an open front and relatively short side walls extending generally parallel to a path of travel of an elevator car door when mounted on the elevator car; an apron plate covering the control box open front and being selectively displaceable to permit access to the control box interior; and mounting means for attachment to the elevator car permitting the control box to be tilted toward a rear wall of the elevator car and drawn into a first maintenance position through an opening in one of a floor and a ceiling of the elevator car.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
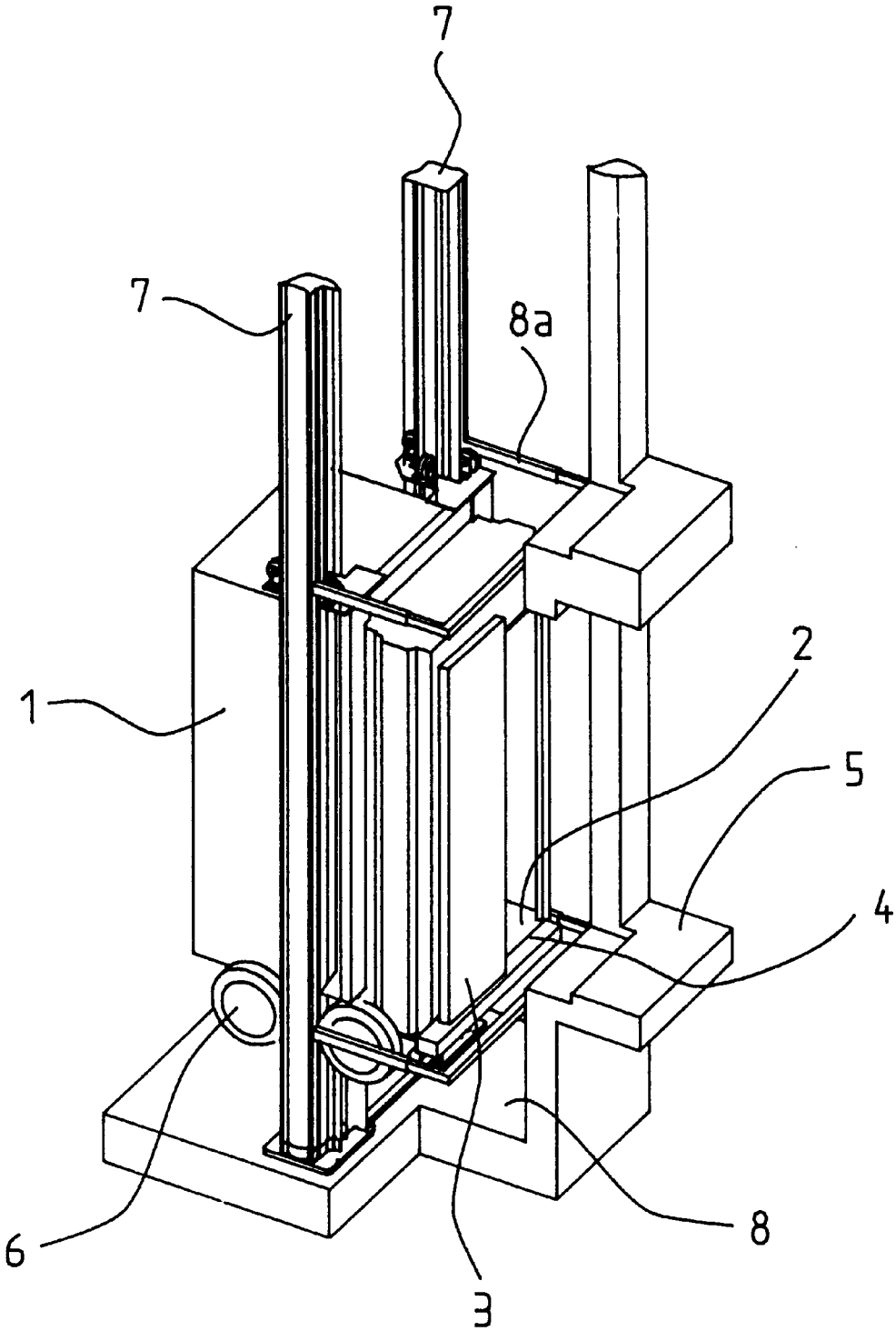
FIG. 1 is a schematic perspective view of an elevator car in an elevator installation.

There is shown in the FIG. 1 an elevator car 1 having a car floor 2 and car doors 3, which car doors run in guide rails 4 at the front edge of the car floor 2. Access to the car 1 by passengers is by way of a hall floor 5 at a desired hall door opening. Disposed below the car floor 2 is a not-shown drive system with a motor, which motor drives drive wheels 6 attached to the car 1. These drive wheels 6 cooperate with a pair of generally vertically extending guide columns 7, on which a top of the car 1 is also guided. The guide columns 7 can be freestanding, or disposed in a shaft 8 and attached to a wall of the shaft by a plurality fastening arms 8*a*.

Figure 2:
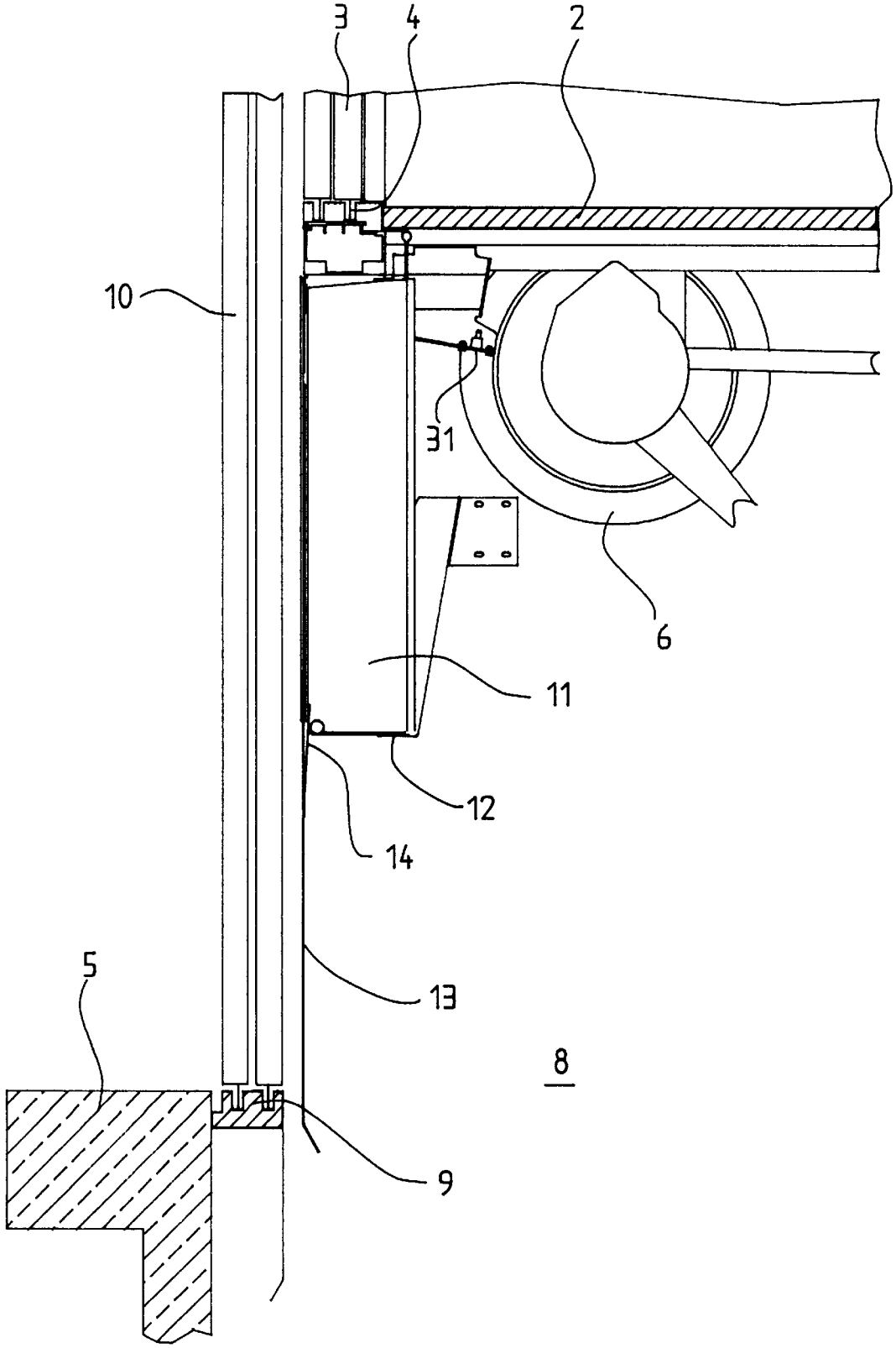
FIG. 2 is a side elevation view of a lower portion of the car shown in the FIG. 1 with a control box according to the present invention.

In the FIG. 2, the car 1 is shown in a maintenance position, in which the car floor 2 is disposed in front of a shaft door opening at about the eye level of a person. Lower guide rails 9 for shaft doors 10 are shown at the front edge of the hall floor 5.

Disposed below the guide rails 4 for the car doors 3 is a control box 11, which here also receives components of the drive. The control box 11 is laterally and downwardly received in a holder 12, which holder is mounted below the door threshold of the car 1. The control box 11 is constructed with a relatively shallow depth and is basically closed on five sides with an open front side for facing the shaft door opening. Thus, the control box 11 is mounted with the four shorter side walls extending generally perpendicular to the paths of travel of the car doors 3 and the shaft doors 10. During travel of the car 1, the open front side of the control box 11 is covered by an apron plate 13 mounted at the holder 12. The control box 11 thus forms the apron which is typically provided on elevator cars and which covers the shaft door opening in the case of inexact stopping of the car at a floor.

In order to open the control box 11, the apron plate 13 is pulled down as shown in the FIG. 2. In this maintenance position, the apron plate 13 covers the shaft door opening in its lower region. In order to release the apron plate 13, initially fastening screws, which are not shown, are released and then retaining springs 14 (see also the FIG. 3) mounted at the apron plate are unnotched by introducing a tool into holes 15. In the lowered end position, the retaining springs 14 notch in again. All electrical components of the control box 11 are now conveniently accessible for service personnel.

Figure 3:
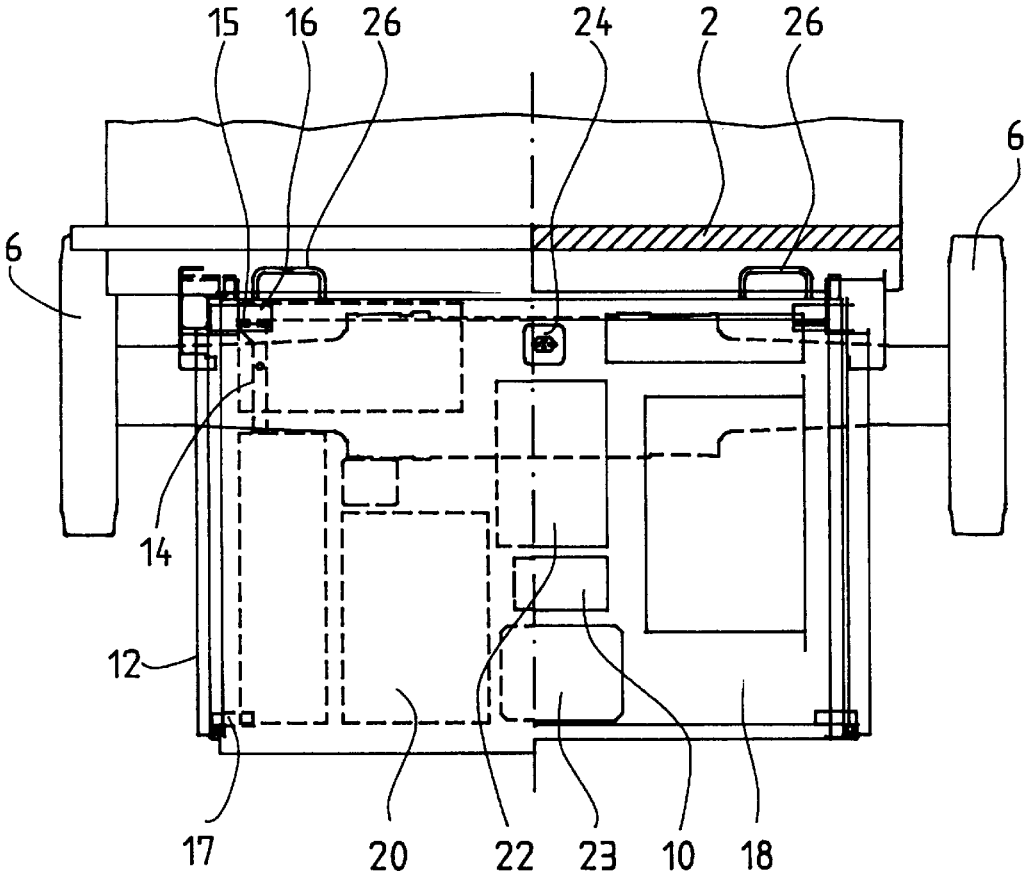
FIG. 3 is a front elevation view of the car shown in the FIG. 2 with the control box in an operational position.

The FIG. 3 shows the control box 11 from the viewpoint of a service person standing in the shaft opening at the guide rails 9, wherein the retaining spring 14 and the hole 15 on the left side are marked in dashed lines. The retaining spring 14 engages by its bent-around end in a slot-shaped opening of an upper detent tongue 16 mounted at the top of the control box. Lower detent tongues 17 receive the retaining springs 14 in the maintenance position of the apron plate 13. A travel and drive regulation unit 19, a frequency inverter 20, a ventilator or cooling unit 21, a circuit breaker 22, a main power supply unit 23, a plug 24 and other electrical components are fastened on a carrier plate 18. Two handles 26 are disposed at the top at the control box 11. The flat mode of construction, which is aligned with the wide side facing the shaft door opening, of the control box 11 allows optimum access to the components. However, if due to space conditions a preferably square mode of construction should be required, the components can, for example, also be arranged in multiple layering on hinged or removable component carriers.

Figure 4:
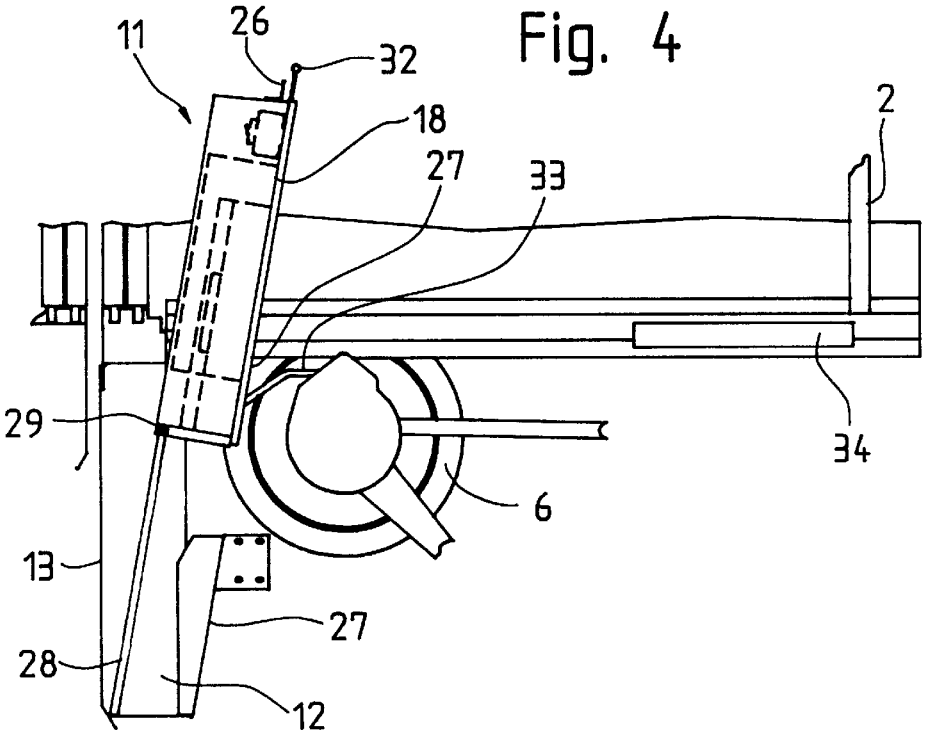
FIG. 4 is side elevation view of the car shown in the FIG. 2 with the control box in a first maintenance position.

In the FIG. 4, the control box 11 is shown disposed in a first maintenance position. The car floor 2 is for that purpose either open in its front region or tipped up in its entirety towards the rear wall of the car. Securing screws (not shown), that fix the carrier plate 18 in its operational position on the holder 12, are released. The holder 12 is provided on its rear side an oblique abutment surface 27, along which the carrier plate 18 can be pulled up by the handles 26. Further, the holder 12 has an obliquely arranged guide 28, in which guide blocks 29 on the carrier plate 18 engage. The front side of the control box 11 is open, as the apron plate 13 remains at the holder 12 as the box is pulled upwardly. In this first maintenance position, the components of the control box 11 are accessible from the car interior for measurements and simple operations. If a fuller access should be required, for example for exchange of components, then the carrier plate 18 can also be pulled entirely out of the holder 12 after release of a securing means (not shown) and be laid on its closed rear side on the car floor 2 or on suitable supports. In this second maintenance position, sufficient standing area for the service person still remains in the rearward region of the car 1; when the car floor 2 is tipped up, the service person stands on step plates 34.

Figure 5:
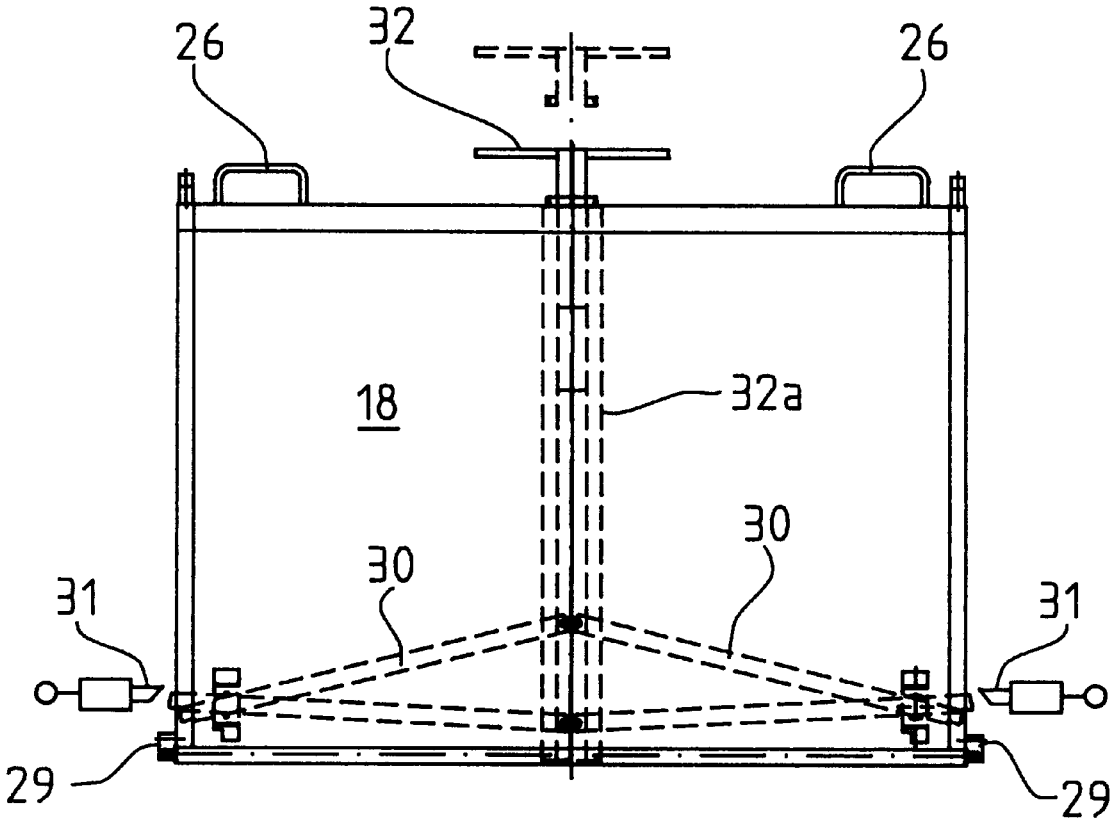
FIG. 5 is front elevation view of the control box showing a latching mechanism.

There is shown in the FIG. 5 a locking mechanism of the carrier plate 18 for the first maintenance position. Two retractable locking bars 30 project laterally in a lower locking position and are detentable at a pair of catches 31 in the region of the abutment surface 27 of the holder 12 (see also the FIG. 2). Upon pulling up the carrier plate 18, the spring-loaded catches 31 automatically fall back under pressure of the locking bars 30. For lowering of the carrier plate 18, the locking bars 30 must be unlocked. This takes place through pulling of an unlatching handle 32, which handle is connected with the ends of the locking bars 30 by way of a pull rod 32*a*. In order to guide the carrier plate 18 from the first maintenance position back into the operational position, then the center unlatching handle 32 is held and the carrier plate 18 is lowered, tipped forward and secured by screws in the operational position.

The control box 11, or the components 19, 20, etc., mounted on the carrier plate 18, remain electrically connected by at least one cable 33 with the motor and the other electrical devices which are not shown, such as a door drive, call transmitters, display devices, etc., in every setting. This enables the complete elevator system to be checked for all elevator functions even in a maintenance operation.

In an alternate embodiment, the control box 11 can also be arranged above the car doors 3. In that case the car 1 is, for maintenance purposes, stopped halfway below a floor, so that the control box 11 is disposed at the working height of a service person standing on the floor 5. In case of an emergency, the control box 11 is also accessible from the interior of the car 1, in that the roof of the car is at least partly removed and the control box is lowered down into the car.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for housing a control system for an elevator system, the elevator system including an elevator car for the transport of persons or goods, the elevator car having a car door as well as a drive system attached thereto, comprising: a control box having a hollow interior for housing elevator drive system components therein, said control box being formed with a relatively narrow depth for mounting on an exterior of an elevator car adjacent a car door, said control box having relatively short side walls extending generally perpendicular to a path of travel of the car door when said control box is mounted on the elevator car.

2. The apparatus according to claim 1 wherein said control box is adapted to be mounted below the elevator car door.

3. The apparatus according to claim 1 wherein said control box is adapted to be mounted above the elevator car door.

4. The apparatus according to claim 1 wherein control box has an open front side covered by an apron plate, said apron plate being selectively displaceable in a downward direction to permit access to said interior of said control box.

5. The apparatus according to claim 4 wherein said apron plate has at least one retaining spring for holding said control box on the elevator car.

6. The apparatus according to claim 1 wherein said control box includes mounting means for attachment to the elevator car permitting said control box to be tilted toward a rear wall of the elevator car and drawn into a first maintenance position through an opening in one of a floor and a ceiling of the elevator car.

7. The apparatus according to claim 5 wherein said mounting means permits said control box to be laid down on a rear wall thereof in a second maintenance position in the elevator car.

8. The apparatus according claim 7 wherein when said control box is mounted on the elevator car with elevator drive system components therein electrically connected with elevator drive and control system components, the elevator drive system components remaining connected to the elevator drive and control system components in each of said first and second maintenance positions.

9. The apparatus according to claim 1 wherein said control box includes at least one releasable locking bar cooperating with a catch on the elevator car.

10. The apparatus according to claim 1 wherein said control box is adapted to be mounted below the elevator car door and a floor of the elevator car can be folded up to expose step plates arranged at a rear portion of the elevator car under the car floor to permit a service person to reach said control box.

11. An apparatus for housing a control system for an elevator system, the elevator system including an elevator car for the transport of persons or goods, the elevator car having a car door as well as a drive system attached thereto, comprising:

a control box having a hollow interior for housing elevator drive system components therein, said control box being formed with an open front and relatively short side walls extending generally parallel to a path of travel of an elevator car door when mounted on an elevator car;

an apron plate covering said control box open front and being selectively displaceable to permit access to said control box interior; and mounting means for attachment to the elevator car permitting said control box to be tilted toward a rear wall of the elevator car and drawn into a first maintenance position through an opening in one of a floor and a ceiling of the elevator car.

12. An elevator car for the transport of persons or goods comprising:

an elevator car having a car door;

an elevator car drive system attached to said elevator car and including a plurality of drive system components, said drive system components including at least one of a travel and/or drive regulation unit, a frequency inverter, a ventilation and/or cooling unit, a circuit breaker and a main power supply unit; and a control box mounted on an exterior of said elevator car and having a hollow interior housing said drive system components, said control box being mounted adjacent said car door.

13. The elevator car according to claim 12 wherein said control box has an open front side covered by an apron plate, said apron plate being selectively displaceable in a downward direction to permit access to said interior of said control box.

14. The elevator car according to claim 12 wherein said control box includes mounting means for attachment to said elevator car permitting said control box to be tilted toward a rear wall of said elevator car and drawn into a first maintenance position through an opening in one of a floor and a ceiling of said elevator car.

15. The apparatus according to claim 12 wherein said control box is adapted to be mounted below said car door and a floor of said elevator car can be folded up to expose step plates arranged at a rear portion of said elevator car under the car floor to permit a service person to reach said control box.

* * * * *